US010544372B2

(12) United States Patent
Zhang et al.

(10) Patent No.: US 10,544,372 B2
(45) Date of Patent: Jan. 28, 2020

(54) DISTILLATION TOWER FOR IMPROVING YIELD OF PETROLEUM HYDROCARBON DISTILLATE AND FEEDING METHOD THEREOF

(75) Inventors: Zhanzhu Zhang, Beijing (CN); Junyi Mao, Beijing (CN); Shuandi Hou, Beijing (CN); Ya Qin, Beijing (CN); Qing Yuan, Beijing (CN); Kejia Xu, Beijing (CN); Tongwang Zhang, Beijing (CN); Shaobing Wang, Beijing (CN); Hongliang Qu, Beijing (CN); Xiaojin Tang, Beijing (CN); Zhenxing Zhu, Beijing (CN); Tao Huang, Beijing (CN)

(73) Assignees: RESEARCH INSTITUTE OF PETROLEUM PROCESSING, SINOPEC, Beijing (CN); CHINA PETROLEUM & CHEMICAL CORPORATION, Beijing (CN)

( * ) Notice: Subject to any disclaimer, the term of this patent is extended or adjusted under 35 U.S.C. 154(b) by 432 days.

(21) Appl. No.: 13/881,535

(22) PCT Filed: Apr. 15, 2011

(86) PCT No.: PCT/CN2011/000665
§ 371 (c)(1),
(2), (4) Date: May 14, 2013

(87) PCT Pub. No.: WO2012/055145
PCT Pub. Date: May 3, 2012

(65) Prior Publication Data

US 2013/0220889 A1 Aug. 29, 2013

(30) Foreign Application Priority Data

Oct. 26, 2010 (CN) ..... 2010 1 0519177

(51) Int. Cl.
*C10G 7/00* (2006.01)
*C10G 7/06* (2006.01)

(52) U.S. Cl.
CPC *C10G 7/00* (2013.01); *C10G 7/06* (2013.01)

(58) Field of Classification Search
CPC .... C10G 2300/1037; C10G 2300/4012; C10G 2300/4025; C10G 2400/02; C10G 7/00; C10G 7/06; C10G 7/12
See application file for complete search history.

(56) References Cited

U.S. PATENT DOCUMENTS 1,394,488 A * 10/1921 French ..... 208/359
2,740,753 A * 4/1956 Schmalenbach ..... 208/2
4,234,391 A * 11/1980 Seader ..... B01D 3/141 165/104.26

FOREIGN PATENT DOCUMENTS

CN 101376068 A 3/2009
CN 101717658 A 6/2010
(Continued)

OTHER PUBLICATIONS

International Search Report dated Jul. 28, 2011, issued in corresponding International Application No. PCT/CN2011/000665.

*Primary Examiner* — Renee Robinson
*Assistant Examiner* — Derek N Mueller
(74) *Attorney, Agent, or Firm* — Scully Scott Murphy & Presser

(57) ABSTRACT

The present invention relates to a method for obtaining a fraction oil yield from petroleum hydrocarbons in a distillation column, wherein said distillation column comprises a fractionation stage, a vaporization section and a stripping stage from the top to the bottom of the distillation column. The method comprises preheating and sending a feedstock oil of petroleum hydrocarbons through a pressure-feeding system at a pressure of 100-1000 kPa higher than the
(Continued)

vaporization section pressure of the distillation column, wherein said preheating is conducted in a heating furnace, wherein said heating furnace has an outlet pressure of 100-1000 kPa higher than the vaporization section absolute pressure, and an outlet temperature of 360-460° C.

12 Claims, 7 Drawing Sheets

(56) References Cited

FOREIGN PATENT DOCUMENTS

| | | | |
|---|---|---|---|
| CN | 102079984 | A | 6/2011 |
| EP | 2 174 697 | A1 | 4/2010 |
| GB | 324376 | | 1/1930 |
| JP | 51-5001 | | 2/1976 |
| JP | S55-123684 | A | 9/1980 |
| JP | S63-006086 | | 1/1988 |
| JP | 2001-129301 | A | 5/2001 |
| WO | 01/42393 | | 6/2001 |

* cited by examiner

PRIOR ART

PRIOR ART

DISTILLATION TOWER FOR IMPROVING YIELD OF PETROLEUM HYDROCARBON DISTILLATE AND FEEDING METHOD THEREOF

TECHNICAL FIELD

The present invention relates to a distillation column for increasing the fraction oil yield and a method for increasing the fraction oil yield from a distillation column, more particular to a distillation column and a method for increasing the fraction oil yield for the heavy oil distillation in the petroleum refining industry.

BACKGROUNDS

The distillation column is a unit device widely used in the petroleum refining industry. For some fractionations of heavy oils, for example, fractionating light fraction oil from crude oil, wax oil and the like, the distillation column generally has a relative high bottom temperature, and the heat source for the reboiler has a high heat grade and is not easy to obtain. Since heavy oils tend to thermally crack at high temperatures, therefore, the distillation columns for crude oil or heavy oil generally don't provide with reboiler, and the heat required by distillation is almost provided by the feedstocks. After preheating feedstocks, the fraction oils are vaporized, the vaporized fraction oils are distilled off from the top and/or the sideline of the column, and non-vaporized streams are distilled off from the bottom of the column. The typical fractionation process for example comprises the atmospheric distillation and the vacuum distillation of crude oil.

The crude and vacuum distillation is the first step of the petroleum refining process, and provide with the starting materials for the subsequent processing units in the refinery, and directly with some final products. The fundamental procedure for the crude oil distillation (by example of fuel oil type) comprises heating the crude oil to about 220-260° C. and then sending it to a primary distillation column. Usually, only one top product, i.e. a reforming feedstock or a light gasoline fraction, is cut from the primary distillation column. In some primary distillation columns, besides the top product, a sideline product is cut off. The primary distillation column bottom oil is sent to the atmospheric column.

The conventional procedure for the atmospheric column is shown in FIG. 1. A primary distillation column bottom oil is heat-exchanged or heated by an atmospheric heating furnace 2 to be partially vaporized, and sent to an atmospheric distillation column 8 through an oil transfer line 7. Lighter components are vaporized in the vaporization section of the distillation column, rise up into the fractionation stage, and are condensed by reflux liquid and removed as top or sideline product to produce fraction oils. Non-vaporized streams flow downwards into the stripping stage, and contacted with steam coming from the column bottom on the column plates of the stripping stage. Non-vaporized lighter fractions are stripped out and rise up along steam into the fractionation stage. Lighter components such as gasoline, kerosene, diesel, heavy diesel are obtained. Non-vaporized streams fall into the column bottom and are removed as atmospheric residue.

The conventional procedure for the vacuum distillation is shown in FIG. 3. Atmospheric residue is heated by a vacuum heating furnace 2 to be partially vaporized, and sent to a vacuum distillation column 6 through an oil transfer line 7.

Lighter components are vaporized in the vaporization section of the vacuum distillation column, rise up into the fractionation stage, and are condensed by reflux liquid and removed as top or sideline product to produce fraction oils. Non-vaporized streams are removed from the column bottom as vacuum residue.

The design and operation of the crude oil distillation unit will have a great effect on the product quality, the product yield and the economical benefit of the refinery. In the provision of the qualified product, increasing the distillation yield of the atmospheric distillation plant so that lighter components are distilled off in the atmospheric distillation column as much as possible and are not sent to the vacuum distillation any more, in one hand, can produce more lighter fractions, and in the other hand, can reduce the loads on the vacuum heating furnace and the vacuum distillation column; increasing the distillation yield of the vacuum distillation plant can increase the yield of fraction oils, and provide more feedstock for catalytic cracking and hydro-cracking so as to improve the economical benefit of the refinery.

The important factors which influence the yield of fraction oils of the atmospheric and vacuum distillation unit are the temperature and oil-vapor partial pressure of the vaporization section in the distillation column. The higher the temperature of the vaporization section is and the lower the oil vapor partial pressure is, the higher the vaporization ratio is, and therefore the higher the distillation yield of fraction oils is.

Currently, there are two methods for reducing the pressure of the vaporization section in the industry: one is to reduce the column top pressure of the distillation column. For the atmospheric distillation column, it is generally to reduce the pressure drops in the column top oil vapor pipeline and the condensing cooler. For the vacuum distillation column, a vacuum pumping equipment of high performance can effectively reduce the column top pressure. The other is to use packings, tower trays and column internals of high performances to effectively reduce the in-column resistance and so as to remarkably reduce the pressure of the vaporization section.

Another approach of increasing the fraction oil yield of the distillation column is to increase the temperature of the vaporization section. The temperature of the vaporization section is influenced by the outlet temperature of the heating furnace. The higher the outlet temperature of the heating furnace is, the higher the temperature of the vaporization section is. However, the temperature of the heating furnace cannot be too high, this is because it is possible for heavy oils to crack at a temperature higher than 360° C., and the coke produced by cracking the oils will badly influence the long and stable run of the plant. Therefore, a heating furnace with a furnace tube having a stepwise increased diameter and an oil transfer line with a large diameter are generally used industrially so as to reduce the outlet pressure of the heating furnace as much as possible, and therefore reduce the temperature of feedstock in the heating furnace with the proviso of ensuring the vaporization ratio of the feedstock.

Currently, the vacuum column top pressure of the industrial plant has reached as low as 1 kPa (abs.), the pressure of the feeding section has reached as low as 3 kPa (abs.), and therefore it is hardly to further reduce the pressure. It is also more and more difficult to improve the performances of the packings and internals, and the cost is sharply increased. There are also some limitations for using the heating furnace with a furnace tube having a stepwise increased diameter and the oil transfer line with a large diameter. One limitation is that increasing the diameter of the furnace tube should be designed rationally according to the properties of the feedstock oil and the characteristics of the heating furnace, while it is very hard for a delicate furnace tube design due to a wide variety of feedstocks. Another limitation is that since a large quantity of feedstock is vaporized in the furnace tube, the density of the feedstock in the tube continuously decreases, especially sharply in a vacuum furnace tube, and therefore the heat-transfer coefficient of the medium in the furnace tube is sharply reduced, which results in the decrease of the overall heat-transfer coefficient in the furnace. In order to achieve the same heat-transfer intensity, a temperature difference should be increased, that is to say, the temperatures of furnace box and furnace tube should be increased. This will lead to a too high topical temperature on the furnace tube wall and influence the use life of the furnace tube.

According to the results of the simulation and calculation, in the furnace tube of the radiation section of the vacuum heating furnace and in the oil transfer line, the flow rate of the vapor phase entrapped with large liquid droplets are very high, the mass transfer area between the vapor and liquid phases is relative small, therefore lighter fractions cannot be completely vaporized and enwrapped in the non-vaporized heavy oils, which results in that the real vaporization ratio of the feedstock coming into the vaporization section of the distillation column is lower than the equilibrium vaporization ratio calculated by the theory. A part of lighter components are present in the column bottom residual oil, and therefore the distillation yield will be decreased. Now, as to the domestic atmospheric and vacuum distillation plants, the design cut point for the vacuum residue is generally set at 540° C. In many vacuum residues, the fraction below 500° C. has a content of greater than 8 wt %; the fraction below 538° C. has a content of greater than 10 wt %, even as high as greater than 30 wt % for some vacuum residues. By example of the atmospheric and vacuum distillation unit of SINOPEC Hainan Refinery, the equilibrium vaporization ratio of the atmospheric residue at the temperature and pressure of the vaporization section of the vacuum distillation column is 59.0 wt %, however, the industrial distillation yield is only 51.9 wt %. This shows that there is a certain gap between the industrial distillation yield and the equilibrium vaporization ratio. Therefore, the vacuum distillation still does not reach the equilibrium vaporization ratio, and there remains a great room for improving the distillation yield.

THE SUMMARY OF THE INVENTION

The object of the present invention is to provide a distillation column and a method for improving a fraction oil yield from petroleum hydrocarbons in the distillation column, especially for improving the fraction oil yield in the atmospheric and vacuum distillation column.

The present invention provides a method for improving a fraction oil yield from petroleum hydrocarbons in the distillation column, wherein said distillation column comprises a vaporization section and a fractionation stage, wherein said method comprises preheating a feedstock oil of petroleum hydrocarbons to be fractionated, sending it through a pressure-feeding system at a pressure of 100-1000 kPa, preferably 200-800 kPa, more preferably 200-600 kPa, and most preferably 200-400 kPa or 200-300 kPa higher than the vaporization section pressure of the distillation column into the vaporization section of the distillation column, atomizing and vaporizing in the vaporization section, and then distillation-separating in the fractionation stage; wherein the fraction oil is removed from column top and/or sideline, and a non-vaporized heavy oil is removed from the column bottom.

In one embodiment of the present invention, said distillation column for petroleum hydrocarbons refers to a distillation column, whose required heat is provided by feedstock and which is not provided with reboiler. It can be a flash column, a primary distillation column, an atmospheric distillation column, a vacuum distillation column or a hydrogenated oil distillation column. Said distillation column generally comprises a vaporization section, a fractionation stage, optional column top/bottom outlets, an optional middle section reflux, an optional sideline, an optional column top vacuum pumping system, an optional stripping stage, and an optional washing stage. Said distillation column can be an empty column, a plate column, or a packed column.

In one embodiment of the present invention, the distillation column has a column top absolute pressure of 0.5-240 kPa, a vaporization section absolute pressure of 1-280 kPa, a vaporization section temperature of 150-430° C.; specifically, in the case of the atmospheric distillation, it has a column top absolute pressure of 110-180 kPa, a vaporization section absolute pressure of 130-200 kPa, a vaporization section temperature of 330-390° C.; and in the case of the vacuum distillation, it has a column top absolute pressure of 0.5-90 kPa, preferably 0.5-10 kPa or 0.5-3 kPa, a vaporization section absolute pressure of 1-98 kPa, preferably 1-5 kPa, a vaporization section temperature of 300-430° C., preferably 370-410° C.

The vaporization section of the distillation column as described herein locates between the upper fractionation stage and a feed inlet for the distillation column. The feedstock is introduced through said inlet into the distillation column, and vaporized in the vaporization section, either completely or partially. The vaporized vapor phase rises up into the upper fractionation stage to conduct heat-exchange and further fractionation. The temperature and pressure of said vaporization section is distributed in a gradient manner. The vaporization section temperature refers to the temperature range of the vaporization section. The vaporization section absolute pressure refers to the absolute pressure range of the vaporization section.

In one embodiment of the present invention, said preheating is conducted in a heating furnace (for example, an atmospheric heating furnace and a vacuum heating furnace). Said heating furnace has an outlet pressure of 100-1000 kPa, preferably 200-800 kPa, more preferably 200-600 kPa, most preferably 200-400 kPa or 200-300 kPa higher than the vaporization section absolute pressure, and an outlet temperature of 360-460° C., preferably 380-430° C.

In one embodiment of the present invention, in case of using a heating furnace, steam can optionally be ejected into the furnace tube of the heating furnace; preferably, steam is not ejected into the furnace tube.

In one embodiment of the present invention, in case of the vacuum distillation, steam can optionally be ejected into the vacuum distillation column; preferably, steam is not ejected into the vacuum distillation column.

In one embodiment of the present invention, said pressure-feeding system comprises a flow distribution system and one or more atomization devices. Said atomization device can be located in the vaporization section of the distillation column, or out of the distillation column, or both.

In one embodiment of the present invention, said flow distribution system will ensure that each atomization device can eject liquid and vapor in any event so as to achieve the atomization effect of the feedstock. Said flow distribution system can be a pipeline system composed of pipelines in one or more of in-line arrangement, staggered arrangement, parallel arrangement, vertical arrangement, loop arrangement, and tree-like arrangement in a symmetric or asymmetric mode. The function of said flow distribution system is to distribute the preheated feedstock to each atomization device, and all pipeline arrangement modes for achieving the above-mentioned function can be regarded as the flow distribution system.

In one embodiment of the present invention, said atomization device can be one or more nozzles or other devices capable of atomizing heavy oil, said one or more nozzles or other devices extends into the vaporization section of the distillation column and/or extends into an atomization vessel which is located out of the distillation column and fluid-communicated with the distillation column. Said atomization device such as nozzles (including but not limited to a rotary-flow type atomization nozzle, a centrifugal atomization nozzle, a variable area pressure-type atomization nozzle) can have one or more pores. The pore direction can be arbitrary. The atomization device can be optionally provided with auxiliary atomizing steam. Said auxiliary atomizing steam can be ejected together with or separately from the feedstock oil. The atomized fine droplets can have sizes sufficient to ensure a good vaporization effect and achieve the object of fractionating the feedstock oil effectively.

Said flow distribution system can be located out of the column and/or in the column. Said flow distribution system can be located out of the atomization vessel and/or in the atomization vessel. Said flow distribution system can be a flow distribution system having an automatic control, or a fully self-regulated flow distribution system having no automatic control. The flow distribution system having an automatic control is mainly composed of pipelines and auto-controlled valves. The flow distribution system having no automatic control distributes streams into atomization devices by a rational design of the resistances in branched pipelines.

In one embodiment of the present invention, said atomization vessel is a vessel have a sufficient space to atomize heavy oils. The example of the atomization vessel comprises an oil transfer line, a flash tank and a flash column. For reforming the existing plant, using the oil transfer line can accomplish utilization of old equipments. If setting the flash tank as atomization vessel, although the equipment capitals increases, the flash tank not only can provide more space and time for atomization and vaporization, but also is more advantageous for separating the vaporized oil vapor and the non-vaporized fine droplets.

In one embodiment of the present invention, said atomization device comprises one or more nozzles or other devices capable of atomizing heavy oil which extend into an atomization vessel which is located out of the distillation column and fluid-communicated with the distillation column, wherein a vapor-phase stream generated in the atomization vessel comes into the vaporization section of the distillation column, and a liquid-phase stream generated in the atomization vessel comes directly into the bottom of the distillation column and mixes with the bottom residual oil, or the vapor-phase stream and the liquid-phase stream generated in the atomization vessel comes into the vaporization section of the distillation column through a same pipeline.

In one embodiment of the present invention, said atomization device comprises one or more nozzles or other devices capable of atomizing heavy oil which extends into the vaporization section of the distillation column, wherein a feedstock oil of petroleum hydrocarbons to be fractionated is preheated, atomized and partially or totally vaporized through a pressure-feeding system at a pressure of 100-1000 kPa, preferably 200-800 kPa, more preferably 200-600 kPa, and most preferably 200-400 kPa or 200-300 kPa higher than the vaporization section pressure of the distillation column, and comes into the vaporization section; wherein the fraction oil is removed from column top and/or sideline, and a heavy oil is removed from the column bottom.

In one embodiment of the present invention, in said distillation column, a foam removal element 9 can be disposed above the vaporization section, and/or a liquid collection element 10 can be disposed below the vaporization section. Said foam removal element can be a demister pad or a vapor-liquid filtration net whose function is to reduce or eliminate the entrainment and avoid liquid to be entrapped by vapor and come into the fractionation stage. Said liquid collection element 10 can be a one- or multiple-layer liquid collection tray, which collects large liquid droplets that are formed from the continuous agglomeration of fine droplets due to their collision with each other. Said collected liquid droplets fall down to the column bottom, and are removed as residual oil. Both the foam removal element 9 and the liquid collection element 10 can be disposed for increasing the fractionation efficiency of the distillation column.

In another aspect, the present invention provides a distillation column for improving a fraction oil yield from petroleum hydrocarbons, wherein said distillation column comprises a vaporization section, wherein said distillation column comprises a pressure-feeding system, through which a feedstock oil of petroleum hydrocarbons to be fractionated is fed at a pressure of 100-1000 kPa higher than the vaporization section pressure of the distillation column.

In one embodiment of the present invention, said distillation column can be a distillation column which is not provided with reboiler, and preferably comprises a flash column, a primary distillation column, an atmospheric distillation column, a vacuum distillation column or a hydrogenated oil distillation column.

In one embodiment of the present invention, in said distillation column, a liquid collection element can be disposed below an inlet for ejecting the feedstock oil and/or a foam removal element can be disposed above the inlet for ejecting the feedstock oil.

In one embodiment of the present invention, said pressure-feeding system comprises a flow distribution system and one or more atomization devices. Said atomization device can be located in the vaporization section of the distillation column, or out of the distillation column, or both.

In one embodiment of the present invention, said atomization device can be one or more nozzles or other devices capable of atomizing heavy oil, said one or more nozzles or other devices extends into the vaporization section of the distillation column and/or extends into an atomization vessel which is located out of the distillation column and fluid-communicated with the distillation column.

In one embodiment of the present invention, said flow distribution system can be located in the column and/or out of the atomization vessel and/or in the atomization vessel.

In one embodiment of the present invention, said atomization vessel comprises an oil transfer line, a flash tank and a flash column.

According to the method and the distillation column of the present invention, the following advantages can be achieved:

(1) The feedstock oil to be fractionated is preheated, and then sent through the pressure-feeding system at a certain pressure into the distillation column. The vaporization of the feedstock oil in the vaporization section is accelerated by the atomization provided by the atomization device. Therefore, the real vaporization ratio of the feedstock oil in the vaporization section is more close to the equilibrium vaporization ratio, and the lighter fraction oils in the feedstock oil are vaporized into the vapor phase as much as possible. In addition, after the atomization into fine droplets, due to a sharp surface-area increase, the vaporization rate will be also increased greatly, which is in favor of increasing the fraction oil yield.

(2) Since the pressure in the furnace tubes of the heating furnace increases, the density of the oils in the furnace tubes increases, and the heat-transfer coefficient and therefore the overall heat-transfer coefficient increase. Thus, at the same heat transfer intensity or the same outlet temperature of the heating furnace, the temperature in furnace box of the heating furnace will be decreased, and therefore the surface temperature of the furnace tube and the cracking of the feedstock oil can be decreased.

(3) Because of a high pressure in the furnace tubes, the oils are substantially not vaporized. Therefore, the multiple enlargements of the diameter of the furnace tube are not necessary. Thus, the structure of the heating furnace is simplified and the diameter of the oil transfer line can be substantially reduced.

(4) In case of applying the present invention to the vacuum distillation, the distillation yield for the vacuum distillation column can be increased, and the diameter for the oil transfer line can be also remarkably decreased; in case of the atmospheric distillation, the distillation yield for the atmospheric distillation column can be increased, and the loads for the vacuum heating furnace and the vacuum column can be decreased; and in case of the atmospheric and vacuum distillation, the overall distillation yield for the atmospheric and vacuum distillation column can be increased, and the operation cost can be decreased.

ILLUSTRATIONS OF DRAWINGS

PREFERRED EMBODIMENTS OF THE INVENTION

In the following context, the method for improving a fraction oil yield from petroleum hydrocarbons and the relevant apparatus of the present invention will be illustrated with reference to the accompanying drawings, but the scope of the present invention is not limited thereto.

Figure 4:
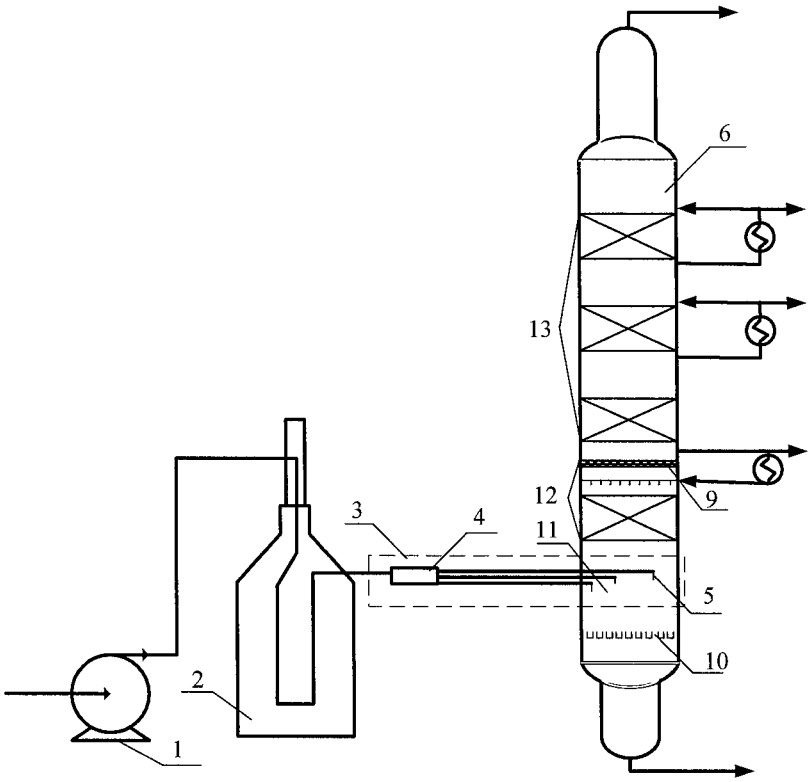
FIG. 4 is a schematic flow chart for a vacuum distillation according to the method of the present invention.

Referring below to FIG. 4 which is an example of vacuum distillation, an embodiment of the present invention is illustrated.

FIG. 4 shows a vacuum distillation process according to the present invention. As shown in FIG. 4, the vacuum distillation column comprises a vaporization section 11, a washing stage 12 and a fractionation stage 13. A feedstock oil to be fractionated (atmospheric residue) is pumped by a feed pump 1 into a heating furnace 2 and preheated. The furnace outlet pressure of the heating furnace 2 is 100-1000 kPa, preferably 200-800 kPa, more preferably 200-600 kPa, most preferably 200-400 kPa or 200-300 kPa higher than the vaporization section pressure of the distillation column. The outlet temperature of the heating furnace is 360-460° C., preferably 380-430° C. The preheated feedstock oil is introduced into a lower part of the distillation column through a pressure-feeding system 3. Said pressure-feeding system comprises a flow distribution system 4 and atomization devices 5. The preheated feedstock oil is distributed by the flow distribution system 4 with a certain distribution ratio, atomized by the atomization device 5 into fine droplets, ejected into the vaporization section 11 of the vacuum distillation column, and vaporized rapidly. Because said fine droplets have large specific surface areas, the vaporizable fractions are thoroughly vaporized in a short time during the movement of fine droplets in the vaporization section. A foam removal element 9 is disposed above the atomization device 5, and a liquid collection element 10 is disposed below the atomization device 5. The fraction vaporized in the vaporization section 11 moves upwards, enters the washing stage 12 and the fractionation stage 13 of the vacuum distillation column, and is removed from the column top or sideline after fractionation to produce a fraction oil product. The structures of the washing stage 12 and the fractionation stage 13 are same as those of conventional vacuum distillation column. A heavy fraction, which is difficult to be vaporized, remains in the liquid state. Large liquid droplets are formed from the continuous agglomeration of fine droplets due to their collision with each other, collected under the action of the liquid collection element 10, fall down to the column bottom, and are removed as residual oil.

Figure 5:
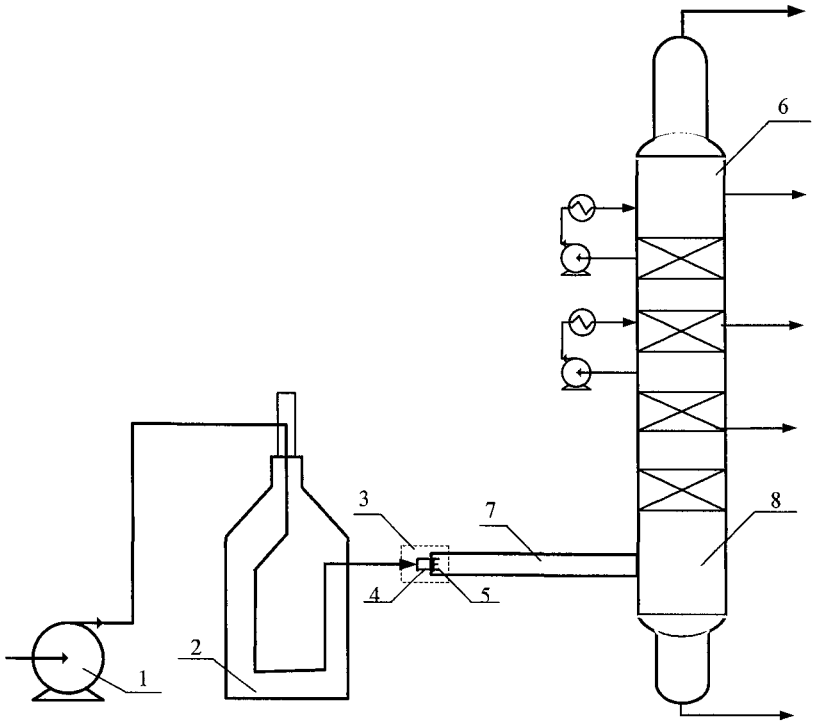
FIG. 5 is a schematic flow chart, wherein the atomization vessel is an oil transfer line.

Referring below to FIG. 5 which is an example of vacuum distillation, an embodiment of the present invention is illustrated, wherein the atomization vessel is an oil transfer line. A feedstock oil to be fractionated (e.g. atmospheric residue) is pumped by a feed pump 1 into a heating furnace 2 and preheated. The in-tube pressure of the heating furnace 2 is 100-1000 kPa, preferably 200-800 kPa, more preferably 200-600 kPa, most preferably 200-400 kPa or 200-300 kPa higher than the vaporization section pressure. The outlet temperature of the heating furnace is 360-460° C., preferably 380-430° C. The preheated feedstock oil is ejected into an oil transfer line 7 through a pressure-feeding system 3. The pressure and temperature in the oil transfer line 7 are 2.0-60.0 kPa (abs.) and 230-460° C. respectively. Fine droplets are thoroughly vaporized under a low oil-vapor partial pressure. The vaporized vapor stream is introduced into the vaporization section 8 of the vacuum distillation column 6. This embodiment can make fine droplets thoroughly vaporize, and therefore increase the distillation yield of the vacuum distillation column.

Figure 6:
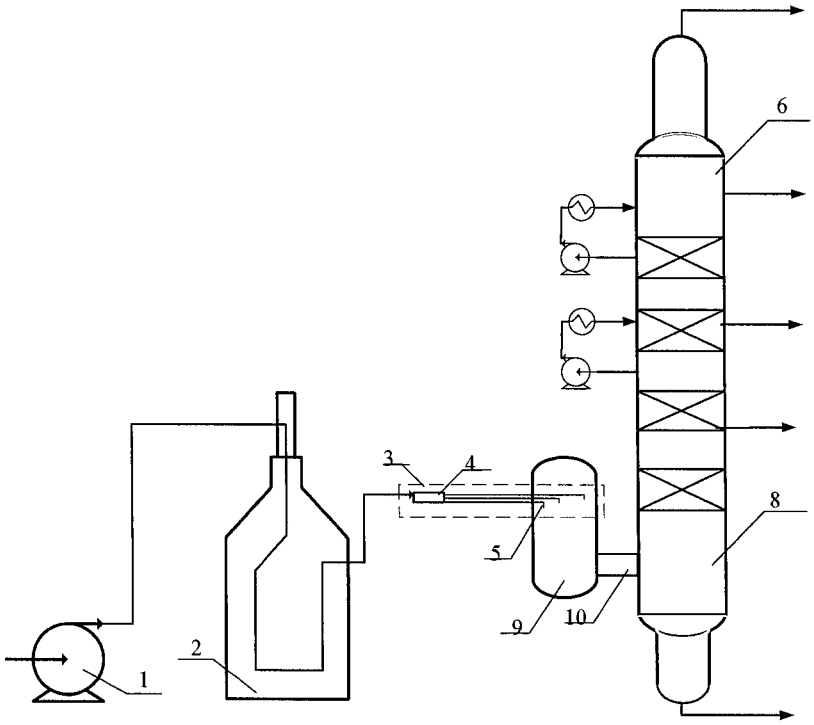
FIG. 6 is a schematic flow chart, wherein the atomization vessel is a flash tank, and the vapor phase and the liquid phase are fed in admixture.

Referring below to FIG. 6 which is an example of vacuum distillation, an embodiment of the present invention is illustrated, wherein the atomization vessel is a flash tank, and the difference from the embodiment with the oil transfer line as the atomization vessel as shown in FIG. 5 comprises the preheated feedstock oil is ejected into a flash tank 9 through a pressure-feeding system 3, wherein the pressure and the temperature in the flash tank 9 are 2.0-60.0 kPa (abs.) and 230-460° C. respectively. Since fine droplets have large specific surface areas, the fraction having a relative low boiling point is flashed and vaporized under a low oil-vapor partial pressure in the flash tank. The thoroughly vaporized vapor stream is introduced into the vaporization section 8 of the vacuum distillation column 6. This embodiment can make fine droplets thoroughly vaporize, and therefore increase the distillation yield of the vacuum distillation column.

Figure 7:
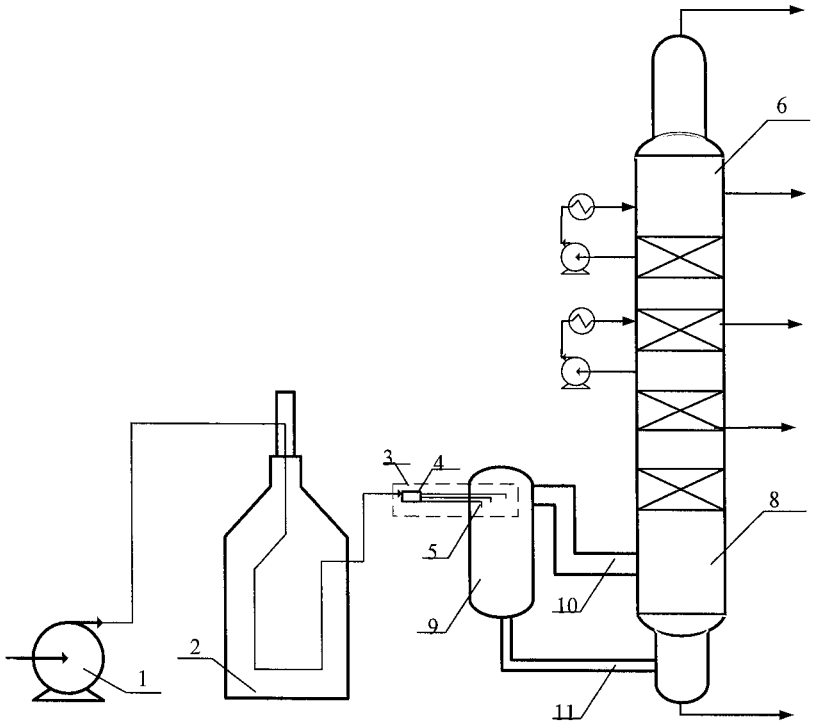
FIG. 7 is a schematic flow chart, wherein the atomization vessel is a flash tank, and the vapor phase and the liquid phase are fed separately.

Referring below to FIG. 7 which is an example of vacuum distillation, an embodiment of the present invention is illustrated. This embodiment is similar with the embodiment with the flash tank as the atomization vessel as shown in FIG. 6 except that the fractions having a relative low boiling point are flashed and vaporized in the flash tank 9, the non-vaporized fractions in the fine droplets collide with each other, and re-aggregate into relative large liquid droplets, which fall into the flask tank bottom, as shown in FIG. 7. The vapor-phase stream in the flash tank is introduced into the vaporization section 8 of the vacuum distillation column 6 via a pipeline 10 from the tank top or the walls close to the tank top. The tank bottom liquid-phase stream is directly sent to the column bottom of the vacuum distillation column via a pipeline 11 and merges into the vacuum residue. This embodiment can better separate non-vaporized heavy fine droplets in the flash tank from the vapor stream, and therefore further reduce the entrainment in the vacuum distillation column.

Comparative Example 1

Comparative Example 1 illustrates the effect of the fractionation of a mixed crude oil by an atmospheric distillation method of the prior art.

Figure 1:
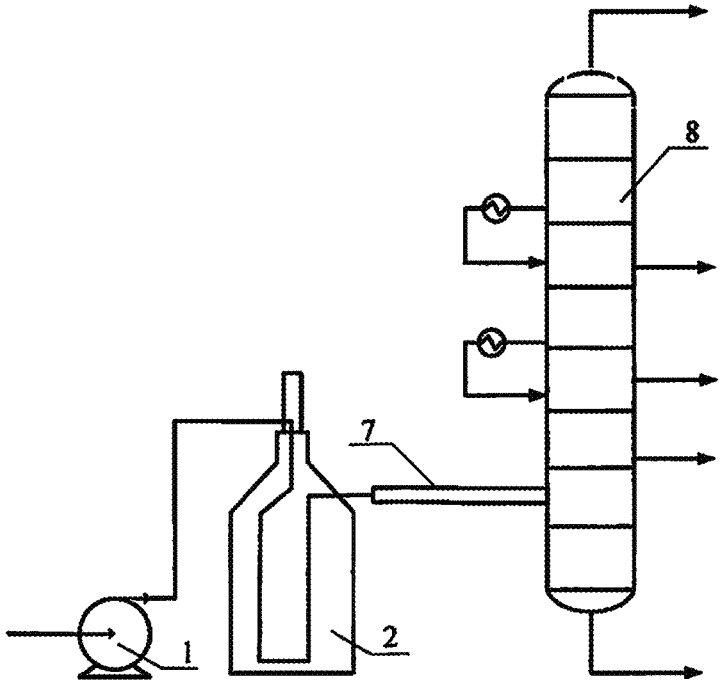
FIG. 1 is a schematic flow chart for a conventional atmospheric distillation.

The mixed crude oil to be fractionated has properties as shown in Table 1. FIG. 1 is a schematic flow chart for an atmospheric distillation method of the prior art. As shown in FIG. 1, the mixed crude oil was firstly heated by an atmospheric heating furnace 2 with an outlet temperature of the heating furnace of 368° C., was sent into an atmospheric distillation column 8 via an oil transfer line 7. Said atmospheric distillation column was a tray column having a diameter of 6.5 m, three sidelines and two middle section refluxes. The fractions such as straight run gasoline, kerosene and diesel were obtained. The operation conditions of the atmospheric distillation column and the product properties are shown in Table 2. The distillation yield of the atmospheric distillation column is 30.2%.

Example 1

Example 1 illustrates the effect of the atmospheric distillation of crude oil according to the method of the present invention.

Figure 2:
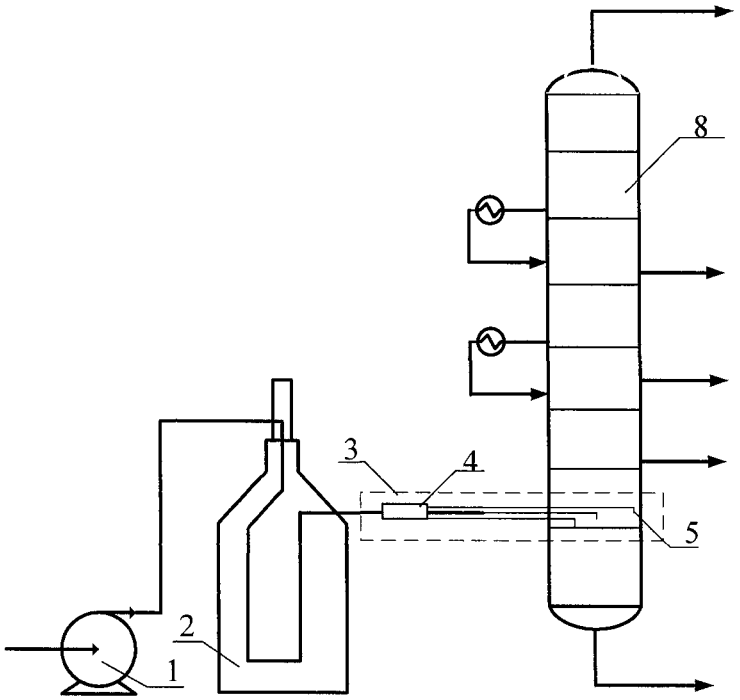
FIG. 2 is a schematic flow chart for an atmospheric distillation according to the method of the present invention.

FIG. 2 is a schematic flow chart for an atmospheric distillation according to the method of the present invention. As shown in FIG. 2, the used atmospheric distillation column 8 was same as that of Comparative Example 1. The feedstock oil to be fractionated was same as that of Comparative Example 1. The feedstock oil, after preheated by the atmospheric heating furnace 2, was ejected to the atmospheric distillation column 8 via a pressure-feeding system (comprising a flow distribution system 4 and atomization devices 5) at a pressure of about 500 kPa higher than the vaporization section pressure of the distillation column. The atmospheric distillation column was provided with the atomization device therein. Said atomization device was a rotary-flow type atomization nozzle. A rotary-flow core was disposed in the front of the nozzle. The top end of the rotary-flow core was equipped with a mono-pore plate. The rotary-flowed liquid, after ejecting via the pore, formed a cone-shaped liquid film. Due to relative high radial and angular velocities, the friction resulted from the velocity difference between the liquid film and the surrounding gases tore up the liquid film into fine droplets. Therefore, a good liquid phase atomization was accomplished. The operation conditions of the atmospheric distillation column and the product properties are shown in Table 2.

TABLE 1

| The properties of the mixed crude oil | |
|---|---|
| Items | Value |
| 20° C. density, kg/m3 | 871.4 |
| True boiling point distillation: | |
| Temperature, ° C. | Yield, wt % |
| <90.0 | 2.4 |
| 140.0 | 6.5 |
| 180.0 | 11.2 |
| 250.0 | 19.5 |
| 300.0 | 27.4 |
| 350.0 | 34.5 |
| 400.0 | 44.0 |
| 450.0 | 54.8 |
| 500.0 | 65.0 |
| >500.0 | 99.5 |
| Loss | 0.5 |

TABLE 2

| Operation conditions of the distillation column and the product properties | | |
|---|---|---|
| Items | Comp Ex 1 | Ex 1 |
| Column top residual pressure, kPa (abs.) | 170.0 | 170.0 |
| Pressure drop of the whole column, kPa | 27.0 | 27.0 |
| Vaporization section pressure, kPa (abs.) | 197.0 | 197.0 |
| Outlet pressure of the atmospheric heating furnace, kPa (abs.) | 246.1 | 412.5 |
| Outlet temperature of the atmospheric heating furnace, ° C. | 368.0 | 372.0 |
| Furnace tube surface temperature of the atmospheric heating furnace, ° C. | 568.0 | 550.2 |
| Vaporization section temperature, ° C. | 365.5 | 364.8 |
| Column top temperature, ° C. | 118.1 | 119.5 |
| Atmospheric distillation column, the first side stream temperature, ° C. | 193.1 | 193.8 |
| Atmospheric distillation column, the second side stream temperature, ° C. | 253.4 | 255.9 |
| Atmospheric distillation column, the third side stream temperature, ° C. | 304.0 | 308.5 |
| Column bottom temperature, ° C. | 352.1 | 353.9 |
| Product | | |
| Product yield, wt % | | |
| Atmospheric distillation column top product | 5.0 | 5.2 |
| Atmospheric distillation column, the first side stream | 7.0 | 7.2 |
| Atmospheric distillation column, the second side stream | 9.9 | 11.0 |

TABLE 2-continued

| Operation conditions of the distillation column and the product properties | | |
|---|---|---|
| Items | Comp Ex 1 | Ex 1 |
| Atmospheric distillation column, the third side stream | 8.3 | 9.8 |
| Atmospheric distillation column bottom product | 69.8 | 66.8 |
| Atmospheric distillation column distillation yield | 30.2 | 33.2 |

It can be seen from Table 2 that when the method of the present invention is used in the atmospheric distillation, relative to the atmospheric distillation with a conventional feeding manner, the outlet pressure of the atmospheric heating furnace is increased by 166.4 kPa, and the outlet temperature of the atmospheric heating furnace is increased by 4.0° C. Under the substantially same vaporization section pressure and temperature, the distillation yield of the present distillation column reaches 33.2% and increases by 3% relative to the conventional feeding manner. The present method, if used in the atmospheric distillation column, can increase the distillation yield of the atmospheric distillation column.

Comparative Example 2

Comparative Example 2 illustrates the effect of the vacuum fractionation of an atmospheric residue according to the prior art.

Figure 3:
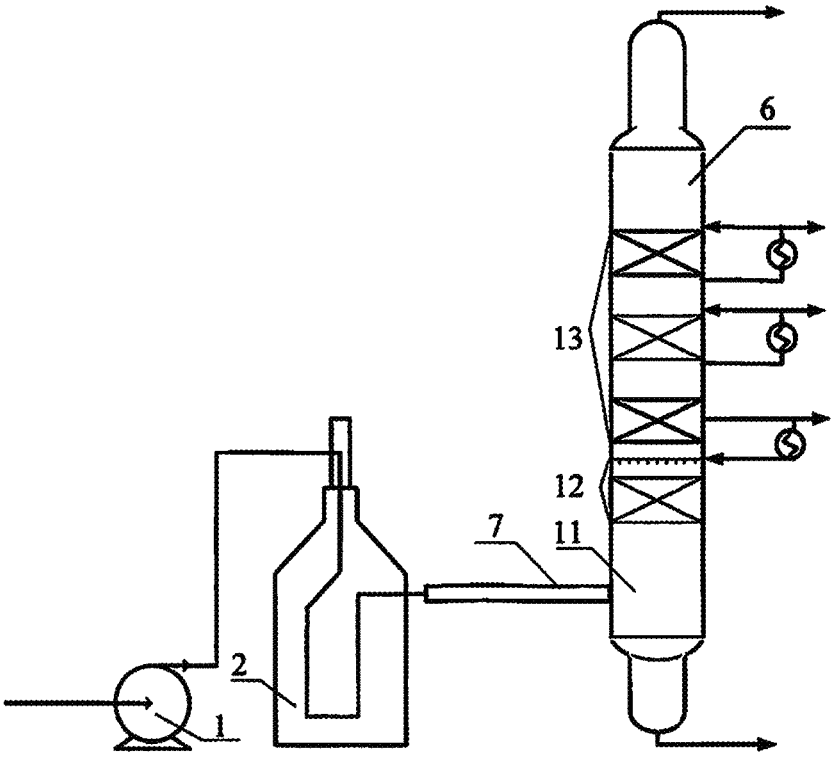
FIG. 3 is a schematic flow chart for a conventional vacuum distillation.

The feedstock oil to be fractionated is an atmospheric residue and has properties as shown in Table 3. FIG. 3 is a schematic flow chart for a vacuum distillation according to the prior art. As shown in FIG. 3, the atmospheric residual oil was heated by a vacuum heating furnace 2 with an outlet pressure of the vacuum heating furnace of 30.0 kPa (abs.), a furnace tube surface temperature of the vacuum heating furnace of 593° C. and an outlet temperature of the vacuum heating furnace of 410° C. The preheated feedstock oil was sent into a vacuum distillation column 6 via an oil transfer line 7. The diameter for the furnace tube of the vacuum heating furnace increased from Φ 152 mm to Φ 273 mm continuously. The oil transfer line had a diameter of 2.0 m and a length of 33.0 m. The feedstock was subjected to a gas liquid separation by a feed distributor in the distillation column. The vacuum distillation column was a conventional full packed column with a diameter of 9.2 m and operated in a dry manner. Said vacuum distillation column comprised a vaporization section, a washing stage and a fractionation stage. The vaporization section temperature was 393.7° C. The washing stage was packed with ZUPAC2 packing (Tianjin Tianda Beiyang Chemical Equipment Co., Ltd.) of 1.5 meters. The fractionation stage was packed with two layers of ZUPAC 1 packing (Tianjin Tianda Beiyang Chemical Equipment Co., Ltd.). The vacuum distillation column comprised four outlets, named as Vacuum top, 1st Vacuum side stream, 2nd Vacuum side stream, and 3rd Vacuum side stream from top to bottom, and two middle section refluxes. A column top vacuum pumping system was operated in a three-level vacuum pumping manner. The operation conditions of the vacuum distillation column and the product properties are shown in Table 4. The distillation yield of the vacuum distillation column is 57.6%.

Example 2

Example 2 illustrates the effect of the vacuum distillation according to the method of the present invention.

FIG. 4 is a schematic flow chart for a vacuum distillation according to the method of the present invention. The feedstock oil to be fractionated was atmospheric residue which was same as that used in Comparative Example 2. The feedstock oil was heated by a vacuum heating furnace 2 with a furnace tube diameter of Φ152 mm. The preheated feedstock oil was sent into an oil transfer line, and ejected to the vacuum distillation column 6 via a pressure-feeding system (comprising a flow distribution system 4 and atomization device 5) at a pressure of about 300 kPa higher than the vaporization section pressure of the distillation column. The vacuum distillation column was provided with the atomization device therein as described in Example 1. The operation conditions of the vacuum distillation column and the product properties are shown in Table 4.

TABLE 3

| The properties of the atmospheric residue | |
|---|---|
| Items | Value |
| 70° C. density, kg/m$^3$ | 909.1 |
| D1160 distillation range data | |
| Yield, volume % | Temperature, ° C. |
| 5 | 344.0 |
| 10 | 368.6 |
| 30 | 438.6 |
| 50 | 505.3 |
| 60 | 548.4 |
| 65.3 | 571.8 |

TABLE 4

| Operation conditions of the vacuum distillation column and the product properties | | |
|---|---|---|
| Items | Comp Ex 2 | Ex 2 |
| Column top residual pressure, kPa (abs.) | 2.6 | 2.6 |
| Pressure drop of the whole column, kPa (abs.) | 1.1 | 1.1 |
| Vaporization section pressure, kPa (abs.) | 3.7 | 3.7 |
| Outlet pressure of the vacuum heating furnace, kPa (abs.) | 30.0 | 279.0 |
| Inlet pressure of the vacuum heating furnace, kPa (abs.) | 470.0 | 470.0 |
| Outlet pressure of the atmospheric column bottom pump, MPa (abs.) | 1.05 | 1.05 |
| Outlet temperature of the vacuum heating furnace, ° C. | 410.0 | 428.0 |
| Furnace tube surface temperature of the vacuum heating furnace, ° C. | 593.0 | 560.0 |
| Vaporization section temperature, ° C. | 393.7 | 392.0 |
| Column top temperature, ° C. | 55.0 | 49.1 |
| Vacuum distillation column, the first sideline temperature, ° C. | 116.1 | 120.5 |
| Vacuum distillation column, the second sideline temperature, ° C. | 232.6 | 237.1 |
| Vacuum distillation column, the third sideline temperature, ° C. | 312.7 | 320.8 |
| Column bottom temperature, ° C. | 374.5 | 376.8 |
| Product | | |
| Product yield, wt % | | |
| Non-condensable gas | 0.3 | 0.2 |
| Vacuum 1st sideline | 5.2 | 5.8 |
| Vacuum 2nd sideline | 34.1 | 35.1 |
| Vacuum 3rd sideline | 18.0 | 19.1 |
| Vacuum residue | 42.4 | 39.8 |
| Distillation yield, wt % | 57.6 | 60.2 |
| The properties of fraction oil | | |
| Density(20° C.), kg/m$^3$ | 905.3 | 912.4 |

TABLE 4-continued

| Operation conditions of the vacuum distillation column and the product properties | | |
|---|---|---|
| Items | Comp Ex 2 | Ex 2 |
| Mixed wax oil residual carbon, %(w) | 0.2 | 0.5 |
| Mixed wax oil C7 insoluble(mg/kg) | 60.0 | 120.0 |
| Mixed wax oil heavy metal content(mg/kg) | 0.2 | 0.5 |
| Mixed wax oil distillation range ASTM D6352 | | |
| Initial boiling point | 282 | 282 |
| 50% | 439 | 447 |
| Final boiling point | 540 | 565 |
| Properties of residual oil | | |
| Residual oil density(20° C.), kg/m$^3$ | 977.3 | 985.8 |
| Residual oil 100° C. kinematic viscosity, mm$^2$/s | 857.0 | 1189.0 |
| Residual oil residual carbon, (mg/kg) | 18 | 22 |
| Residual oil <500° C. fraction content, % | 4.3 | 1.3 |
| Residual oil 500-550° C. fraction content, % | 12.6 | 8.7 |
| Residual oil 550-600° C. fraction content, % | 18.0 | 14.1 |
| Residual oil >600° C. fraction content, % | 65.1 | 75.9 |

It can be seen from Table 4 that when the method of the present invention is used in the vacuum distillation, relative to the vacuum distillation with a conventional feeding manner of Comparative Example 2, under the same vaporization section pressure and temperature, the distillation yield of the present vacuum distillation column reaches 60.2% and increases by 2.6% relative to the conventional feeding manner. The outlet temperature of the vacuum heating furnace increases by 18° C. The surface temperature of the furnace tube decreases by 33° C. The non-condensable gas content in the vacuum distillation column top product decreases from 0.3% to 0.2%. In the conventional feeding manner, the vacuum heating furnace has a furnace tube with a stepwise increased diameter and it is complex. According to the present invention, the diameters for the furnace tube and the oil transfer line are both Φ152 mm, which simplifies the structures of the furnace tube and the oil transfer line. In addition, in comparison with Comparative Example 2, the final boiling point for the vacuum wax oil increases by 25° C. All of density, viscosity, heavy metal contents and residual carbon content increase, but still meet the subsequent feedstock requirements by the downstream units. In the vacuum residue, the content for the fractions below 500° C. decreases from 4.3% to 1.3%, while the content for the fractions above 600° C. increases from 65.1% to 75.9%. The density, viscosity and residual carbon content of the residual oil increase remarkably.

Comparative Example 3

Comparative Example 3 illustrates the effect of the vacuum distillation of an atmospheric residue according to the prior art.

A mixed crude oil to be fractionated was introduced into an atmospheric distillation column, and fractionated into straight run gasoline, kerosene, and diesel fractions. The distillation yield for the atmospheric distillation column was 32 wt %. Similarly to FIG. 5 except that a pressure-feeding system 3 is not present, atmospheric residue from the atmospheric distillation column was sent to a heating furnace 2 of the vacuum distillation system via an oil pump 1, preheated, and then introduced into the vaporization section 8 of the vacuum distillation column via an oil transfer line 7. The outlet pressure of the vacuum heating furnace was 30.0 kPa (abs.). The furnace wall temperature was 561° C. The outlet temperature of the vacuum heating furnace was 386° C. The vacuum heating furnace had a furnace tube with a stepwise increased diameter. The vacuum distillation column was a high-efficient full packed column. The vaporization section temperature of the vacuum distillation column was 374° C. The properties of the mixed crude oil are shown in Table 5. The operation conditions of the vacuum distillation column and the product properties are shown in Table 6. The distillation yield of the vacuum distillation column is 29.8%.

Example 3

Example 3 illustrates the effect of the vacuum distillation of crude oil according to the method of the present invention.

The used atmospheric distillation column system and the mixed crude oil to be fractionated were same as those used in Comparative Example 3. The distillation yield of the atmospheric distillation column was 32 wt %. As shown in FIG. 5, the atmospheric residue from the atmospheric distillation column was sent to a heating furnace 2 of the vacuum distillation system via an oil pump 1, preheated, then ejected into then oil transfer line 7 via a nozzle 5, thoroughly vaporized in the oil transfer line, and then introduced into the vaporization section 8 of the vacuum distillation column via the oil transfer line. The inlet pressure of the oil transfer line was 14.0 kPa, and the inlet temperature was 386° C. The used nozzle is a centrifugal atomization nozzle. The furnace tube of the heating furnace had a constant diameter. The used oil transfer line and vacuum distillation column had the same structures as those of Comparative Example 3. The vaporization section temperature of the vacuum distillation column was 381° C.

From the results of Table 6, it can be seen that by disposing a nozzle on the oil transfer line, under the same pressure of the vaporization section of the vacuum distillation column as that of Comparative Example 3, the outlet pressure of the vacuum heating furnace reaches 280.0 kPa, and the furnace wall temperature reaches 556° C., which is 5° C. lower than that of Comparative Example 3. The outlet temperature of the vacuum heating furnace reaches 418° C., which is 22° C. higher than that of Comparative Example 3. Fine droplets ejected into the oil transfer line are flashed and vaporized in the oil transfer line, and sent into the vaporization section of the vacuum distillation column, still remaining at the substantially same temperature as Comparative Example 3. Under the same vaporization section pressure as Comparative Example 3, the distillation yield after the feedstock passing through the vacuum distillation of Example 3 reaches 33.7 wt %, which is 3.9% higher than that of Comparative Example 3. The vacuum residue density and viscosity increase. In the vacuum residue, the mass content for the fractions below 500° C. decreases from 10% (Comparative Example 3) to 5.8%.

Example 4

Example 4 illustrates the effect of the vacuum distillation of crude oil according to the method of the present invention.

The used atmospheric distillation column system and the mixed crude oil to be fractionated were same as those used in Comparative Example 3. The distillation yield of the atmospheric distillation column was 32 wt %. As shown in FIG. 6, the used vacuum distillation column was same as that of Comparative Example 3, and the used vacuum heating furnace was same as that of Example 3. Exception is that a flash tank 9 was added after the vacuum heating furnace. The atmospheric residue was subjected to the flow distribution via the flow-distribution system 4, then ejected into the flash tank via a nozzle 5, thoroughly vaporized, and introduced into the vaporization section of the vacuum distillation column. The flash tank pressure was 6.1 kPa, and the temperature was 382° C. The other operation conditions and the product properties are shown in Table 6.

It can been seen from Table 6 that by disposing the atomization nozzle and the flash tank at the outlet of the vacuum heating furnace in Example 4, the distillation yield of the vacuum fraction oil in the atmospheric residue reaches 34.5 wt %, which is 4.7% higher than that of Comparative Example 3.

Example 5

Example 5 illustrates the effect of the vacuum distillation of crude oil according to the method of the present invention.

The used atmospheric distillation column system and the mixed crude oil to be fractionated were same as those used in Comparative Example 3. The distillation yield of the atmospheric distillation column was 32 wt %. The used vacuum distillation column according to Example 5 was structurally same as that of Example 4. The used vacuum heating furnace was structurally same as that of Example 4. The used flash tank was same as that of Example 4. As shown in FIG. 7, the atmospheric residue was subjected to the flow distribution via the flow-distribution system 3, then ejected into the flash tank 9 via a nozzle 5, thoroughly vaporized, and introduced into the vacuum distillation column, wherein gas and liquid phases are in different pipelines. The flash tank pressure was 6.1 kPa, and the temperature was 382° C. The other operation conditions and the product properties are shown in Table 6.

It can been seen from Table 6 that, in Example 5, by disposing an atomization-type pressure-feeding system and the flash tank at the outlet of the vacuum heating furnace, the distillation yield of the vacuum fraction oil in the atmospheric residue reaches 35.1 wt %, which is 5.3% higher than that of Comparative Example 3.

TABLE 5

| The properties of the mixed crude oil | |
|---|---|
| Items | Value |
| Density/(kg/m$^3$) | 798.6 |
| Kinematic viscosity/(mm$^2$/s) | 65.7 |
| True boiling point distillation | |
| Temperature/° C. | Yield/(wt %) |
| <90° C. | 2.1 |
| 140° C. | 6.9 |
| 180° C. | 12.5 |
| 250° C. | 19.8 |
| 300° C. | 26.9 |
| 350° C. | 35.2 |
| 370° C. | 41.4 |
| 400° C. | 44.6 |
| 450° C. | 55.9 |
| 500° C. | 67.4 |
| >500° C. | 99.2 |
| Loss | 0.8 |

TABLE 6

| Operation conditions of the vacuum distillation column and the product properties | | | | |
|---|---|---|---|---|
| Items | Comp. Ex 3 | Ex 3 | Ex 4 | Ex 5 |
| Main operation conditions | | | | |
| Column top residual pressure, kPa | 2.0 | 2.0 | 2.0 | 2.0 |
| Pressure drop of the whole column, kPa | 2.7 | 2.7 | 2.7 | 2.7 |
| Vaporization section pressure, kPa | 4.7 | 4.7 | 4.7 | 4.7 |
| Outlet pressure of the heating furnace, kPa | 30.0 | 280.0 | 300.0 | 300.0 |
| Steam for nozzle atomization/Atmospheric column residual oil, m/m | — | 0.0058 | 0.0065 | 0.0065 |
| Outlet temperature of the vacuum heating furnace, ° C. | 386 | 418 | 418 | 418 |
| Furnace wall temperature of the vacuum heating furnace, ° C. | 561 | 556 | 556 | 556 |
| Vaporization section temperature of the vacuum column, ° C. | 374 | 379 | 379 | 379 |
| Column bottom Temperature, ° C. | 369 | 374 | 373 | 373 |
| Product yield, wt % | | | | |
| Vacuum residue | 29.2 | 25.3 | 24.5 | 23.9 |
| Atmospheric distillation column distillation yield | 32.0 | 32.0 | 32.0 | 32.0 |
| Vacuum distillation column distillation yield | 29.8 | 33.7 | 34.5 | 35.1 |
| Residual oil properties | | | | |
| Vacuum residue specific gravity, g/cm$^3$ | 0.9773 | 0.9860 | 0.9871 | 0.9876 |
| Vacuum residue <500° C. fraction content (%) | 10 | 5.8 | 5.1 | 5.1 |
| Vacuum residue 100° C. kinematic viscosity (mm$^2$/s) | 857 | 1391 | 1407 | 1431 |

The invention claimed is:

1. A method for improving a fraction oil yield from petroleum hydrocarbons in a distillation column, wherein said distillation column comprises a fractionation stage, a vaporization section and a stripping stage from the top to the bottom of the distillation column, wherein said method comprises preheating a feedstock oil of petroleum hydrocarbons to be fractionated, sending the feedstock oil through a pressure-feeding system at a pressure of 100-1000 kPa higher than the vaporization section pressure of the distillation column into the vaporization section of the distillation column so that the feedstock oil is atomized and vaporized, in the vaporization section, and then distillation-separating the atomized and vaporized feedstock oil in the fractionation stage; wherein fraction oils are removed from column top and removed from one or more sidelines, and a non-vaporized heavy oil is removed from the column bottom, wherein the distillation column is an atmospheric distillation column having a column top absolute pressure of 110-180 kPa, a vaporization section absolute pressure of 130-200 kPa, and a vaporization section temperature of 330-390° C., wherein said preheating is conducted in a heating furnace, wherein said heating furnace has an outlet pressure of 100-1000 kPa higher than the vaporization section absolute pressure, and an outlet temperature of 360-460° C.

2. The method of claim 1, wherein the pressure-feeding system is at a pressure of 200-300 kPa higher than the vaporization section pressure of the distillation column.

3. The method of claim 1, wherein said heating furnace has an outlet pressure of 200-300 kPa higher than the vaporization section absolute pressure, and an outlet temperature of 380-430° C.

4. The method of claim 1, wherein in said distillation column, a liquid collection element is disposed below an inlet for injecting the feedstock oil and/or a foam removal element is disposed above the inlet for injecting the feedstock oil.

5. The method of claim 1, wherein said pressure-feeding system comprises a flow distribution system and one or more atomization devices; wherein said one or more atomization devices can be located in the vaporization section of the distillation column, or out of the distillation column, or both.

6. The method of claim 5, wherein said atomization device is one or more nozzles, and said one or more extend into the vaporization section of the distillation column and/or extend into an atomization vessel that is located out of the distillation column and fluid-communicated with the distillation column.

7. The method of claim 6, wherein said flow distribution system is located in the column and/or out of the atomization vessel and/or in the atomization vessel.

8. The method of claim 6, wherein the atomization vessel comprises an oil transfer line, a flash tank and a flash column.

9. The method of claim 5, wherein said atomization device comprises one or more nozzles that extend into an atomization vessel, said atomization vessel is located out of the distillation column and fluid-communicated with the distillation column, wherein a vapor-phase stream generated in the atomization vessel comes into the vaporization section of the distillation column, and a liquid-phase stream generated in the atomization vessel comes directly into the bottom of the distillation column and mixes with the bottom residual oil, or the vapor-phase stream and the liquid-phase stream generated in the atomization vessel comes into the vaporization section of the distillation column through a same pipeline.

10. The method of claim 5, wherein said atomization device comprises one or more nozzles extend into the vaporization section of the distillation column, wherein a feedstock oil of petroleum hydrocarbons to be fractionated is preheated, atomized and partially or totally vaporized through the pressure-feeding system at a pressure of 100-1000 kPa higher than the vaporization section pressure of the distillation column, and comes into the vaporization section; wherein the fraction oil is removed from the column top and removed from one or more of the sidelines, and a heavy oil is removed from the column bottom.

11. The method of claim 1, wherein the feedstock oil is atomized and vaporized completely in the vaporization section.

12. The method of claim 11, wherein the fraction oil is steadily and continuously removed from the column top and from one or more of the sidelines.

* * * * *